United States Patent [19]

Brieger

[11] 4,105,073

[45] Aug. 8, 1978

[54] TUBING CONVEYED SAND CONSOLIDATING METHOD

[76] Inventor: Emmet F. Brieger, General Delivery, Nogal, N. Mex. 88341

[21] Appl. No.: 836,396

[22] Filed: Sep. 26, 1977

[51] Int. Cl.[2] ..... E21B 43/00; E21B 43/117

[52] U.S. Cl. ..... 166/286; 166/297; 166/295; 175/4.52; 175/4.6; 102/21.6

[58] Field of Search ..... 166/286, 297, 298, 299, 166/55, 292–295; 175/4.6, 4.5, 4.51, 4.52; 102/21, 21.6, 21.8

[56] References Cited

U.S. PATENT DOCUMENTS

| | | | |
|---|---|---|---|
| 2,796,023 | 6/1957 | Abendroth | 175/4.52 |
| 3,153,449 | 10/1964 | Lebourg | 166/286 |
| 3,212,576 | 10/1965 | Lanmon | 166/286 X |
| 3,318,381 | 5/1967 | Brandt | 175/4.52 X |
| 3,329,204 | 7/1967 | Brieger | 175/4.52 X |
| 3,346,049 | 10/1967 | Brown | 166/286 |
| 3,347,315 | 10/1967 | Lanmon | 166/286 |
| 3,348,621 | 10/1967 | Schuster | 166/286 X |
| 3,706,340 | 12/1972 | Schuster | 175/4.6 X |
| 3,706,344 | 12/1972 | Vann | 166/297 |

*Primary Examiner*—Stephen J. Novosad
*Attorney, Agent, or Firm*—Marcus L. Bates

[57] ABSTRACT

Method of completing a hydrocarbon containing formation located downhole in a cased borehole by running a jet perforating gun downhole on the end of a tubing string. The tool string includes a vent assembly underlying a packer and located above the gun. The gun includes a special flexible linkage and biasing means which urges the shaped charge chambers of the gun into close proximity of the borehole wall. Pairs of shaped charges are positioned within spaced chambers to intersect one another out in the formation, to thereby enable a cavity to be subsequently formed therebetween. Treatment fluid is pumped into the cavity and used to consolidate the formation. Another form of the invention provides a wireline actuated apparatus wherein pairs of shaped charges are oriented to penetrate the formation and form spaced apart parallel tunnels which subsequently collapse to jointly form an enlarged cavity located back up in the formation. In each of the embodiments one of the charge carriers is located in an isolated chamber, and an isolated flow path is established which extends from the borehole, into one tunnel, from the other tunnel, directly into the isolated chamber thereby producing a surge of flow across the two tunnels which enhance the formation of the enlarged cavity.

13 Claims, 6 Drawing Figures

TUBING CONVEYED SAND CONSOLIDATING METHOD

BACKGROUND OF THE INVENTION

One of the major problems associated with plastic consolidation of unconsolidated hydrocarbon containing formations is the inability to consistently inject plastic into all of the perforations made by the shaped charges of perforating guns. This results in failure to consolidate the sand opposite every one of the perforations to assure that none of the perforations will produce sand. If any one of the perforations should produce sand, the perforating or completion job is unsatisfactory and must be reworked because the well will otherwise produce sand. Further, it is difficult to provide an open perforation tunnel or cavity extending from the wellbore, through the casing and back up into the formation which assures a production rate equal to the full potential of the well.

Moreover, the resulting perforations often are lined with debris from the shaped charge which prevents injection of the consolidating fluids. This causes sand to flow from the perforations, or alternatively, forms a low permeability plug with subsequent restriction in production.

It would therefore be desirable to form a cavity back up into a hydrocarbon containing formation by the employment of a plurality of jet perforating shaped charges; to remove any resulting debris occasioned by the act of perforating; and thereafter, to treat the unconsolidated formation in such a manner that it is consolidated and hence, no sand can be produced. It is furthermore desirable that such a cavity be of sufficient size and configuration to assure realization of a production rate substantially equal to the full potential of the well.

SUMMARY OF THE INVENTION

This invention relates to oil well completion apparatus and specifically to a method and an apparatus for completing a hydrocarbon containing formation located downhole in a borehole. The well completion method comprises running a jet perforating gun downhole into a borehole and positioning the gun such that the shaped charges contained therewithin are positioned closely adjacent to the inside wall surface of the casing to be perforated. Two spaced chambers contain shaped charges therewithin. One shaped charge is located in a low pressure chamber. In one embodiment of the invention, each of the spaced charges are angulated towards one another so that when the gun is detonated, interconnecting tunnels are formed which extend back up in the adjacent formation. In another embodiment of the invention, the shaped charges are arranged in pairs and directed horizontally away from one another to form the tunnels.

The shaped charge of the low pressure chamber penetrates the gun wall and the casing tubing through a resilient toroidial shaped seal device, which seals the interface formed between the casing and gun wall, thereby providing an isolated flow path from the wellbore, into the formation, and back into the low pressure chamber.

Upon detonation, pre-flush fluid flows from the lower borehole annulus, through the two intersecting tunnels formed by the two spaced charges, and into the reduced pressure chamber, thereby cleaning debris from the tunnels while simultaneously forming a cavity within the formation between the two perforations.

A sand consolidating fluid is next forced back into the cavity and back up into the formation. An oil base mud follows the consolidating fluid, and pressure higher than the formation pressure is maintained thereon, thus holding all the cavities propped open so that the sand cannot collapse while the plastic is hardening. After the plastic material has hardened, the well is put on production, thereby flushing the mud out of the cavity and leaving the plastic consolidated sand which is sufficiently strong to prevent collapse of the cavities.

Accordingly, a primary object of this invention is the provision of a method of completing a hydrocarbon containing formation in a manner which perforates the well and removes debris from the perforations.

Another object of the present invention is the provision of a method by which intersecting perforations from a jet gun are surged with pre-flush fluid to thereby form a cavity within the formation.

A further object of this invention is to disclose and provide a method of well completion wherein adjacent perforations are oriented in intersecting relationship with one another and fluid is caused to flow therethrough to thereby remove debris from the perforations and at the same time form a cavity back up in the hydrocarbon producing formation, and thereafter consolidate the unconsolidated formation so that the cavity does not subsequently collapse when the well is put on production.

A still further object of this invention is the provision of apparatus by which the foregoing method can be carried out.

Another and still further object is the provision of a tubing conveyed perforating and sand consolidating system which includes a perforating gun positioned adjacent to a hydrocarbon containing formation, and means by which a cavity is formed back up in the formation by two co-acting shaped charges followed by treatment of the formation with chemicals pumped into the borehole.

An additional object of this invention is the provision of permanent completion apparatus by which a tubing conveyed perforating gun can be arranged immediately adjacent a hydrocarbon containing formation and the shaped charges thereof arranged to form a cavity back up in the formation.

These and various other objects and advantages of the invention will become readily apparent to those skilled in the art upon reading the following detailed description and claims and by referring to the accompanying drawings.

The above objects are attained in accordance with the present invention by the provision of a method of completing a well and consolidating a sand formation for use with apparatus fabricated in a manner substantially as described in the above abstract and summary.

DETAILED DESCRIPTION OF THE PREFERRED EMBODIMENT

Throughout the figures of the drawings, wherever it is possible or logical to do so, like or similar numerals will refer to like or similar elements.

Figure 1:
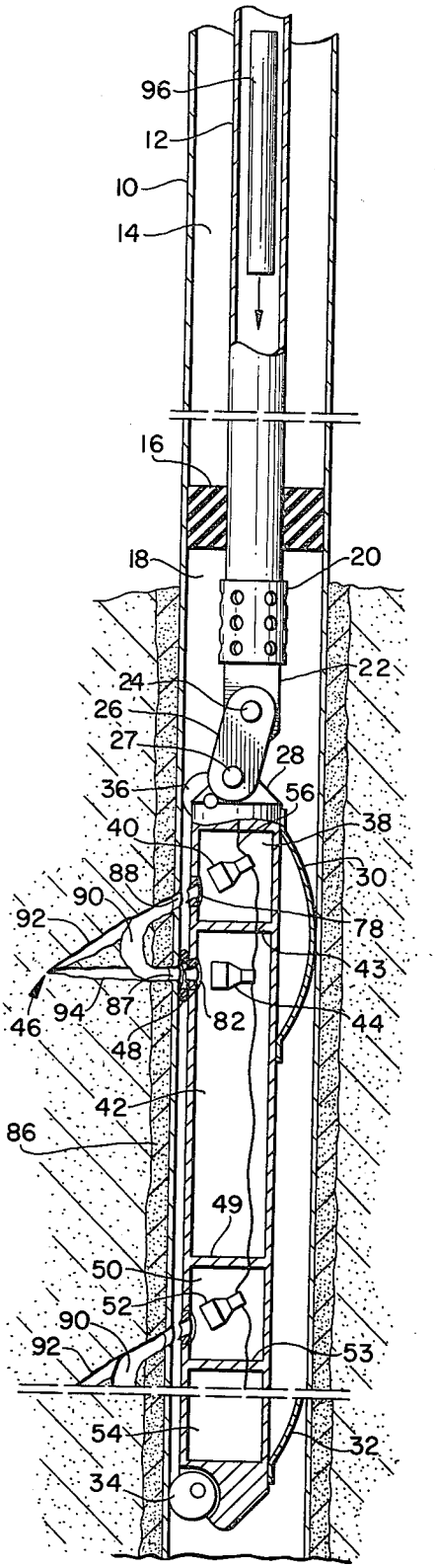
FIG. 1 is a part diagrammatical, part schematical, part cross-sectional representation of a wellbore having apparatus disposed therein made in accordance with the present invention and by which the method of the present invention can be carried out.

FIG. 1 discloses a cross-sectional view of a formation having a cased borehole 10 which extends therethrough and down into the earth perhaps several thousand feet. A tubing string 12 is concentrically disposed within the cased borehole, thereby leaving upper casing annulus 14. The casing and tubing string terminate in the usual well head (not shown) at the surface of the earth. Packer 16 is of conventional design and separates annulus 14 from annulus 18.

Vent assembly 20 can take on any number of different forms, but preferably is made in accordance with the Vann U.S. Pat. No. 3,871,448 which enables the vent assembly to be closed until the packer 16 is set, whereupon the vent is automatically opened. Other packers and vent assemblies can be equally well employed by utilizing wire line techniques for opening the vent assembly.

Firing head 22 is of a type which detonates a number of shaped jet charges whenever the illustrated "go-devil" 96 is dropped down the tubing string and into contact with the firing mechanism thereof. Details of this type firing head are found in Vann U.S. Pat. No. 3,706,344.

Pin 24 connects a pair of spaced links 26 to the firing head while pin 27 connects the other end of the links to an upper gun sub 28 so that the gun can be urged laterally of the borehole and into abutment with the inside peripheral well surface of the casing.

Upper and lower bow springs 30, 32 are affixed to the gun and resiliently engage the inside peripheral wall surface of the casing and urges the entire gun apparatus laterally towards the opposed side of the casing thereby causing lower and upper cams 34 and 36 to bear against the inside casing wall.

Figure 2:
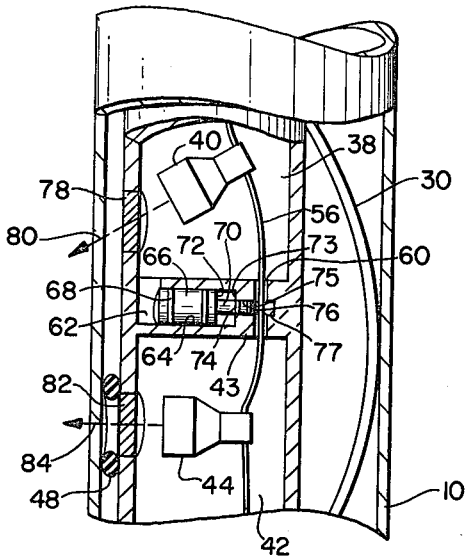
FIG. 2 is an enlarged, fragmented, part cross-sectional representation which sets forth some of the details of the apparatus disclosed in FIG. 1.
Figure 3:
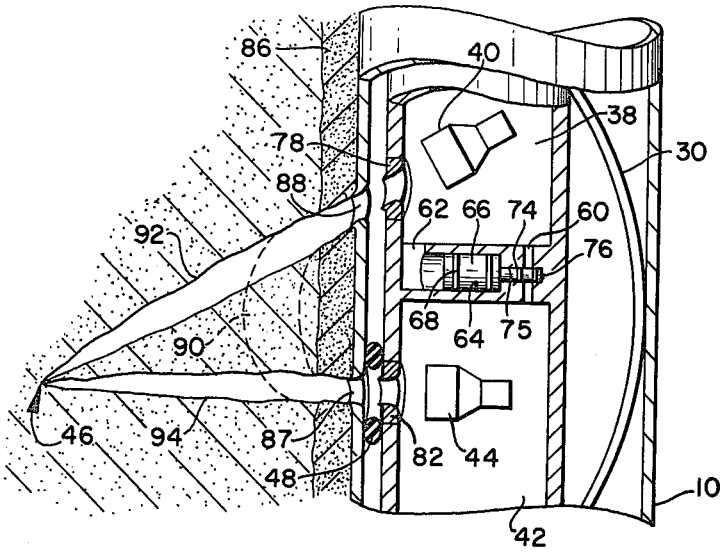
FIG. 3 is an enlarged, fragmented, part cross-sectional representation of part of the apparatus disclosed in FIG. 1 which sets forth some of the details of the operation of the present invention.

As seen in FIGS. 1–3, a relatively small upper chamber 38 has a charge carrier located therein for holding a shaped charge 40 oriented in the illustrated direction. The next adjacent, relatively large chamber 42 is separated from the relatively small chamber 38 by means of a special bulkhead 43, the details of which will be more thoroughly discussed later on in this disclosure. Large chamber 42 includes a charge carrier by which the shaped charge 44 is oriented in the illustrated direction.

The two shaped charges 40 and 44 of FIGS. 1–3 are arranged respective to one another so that they are focused toward a common location 46 back up in the hydrocarbon containing formation. To achieve this result, it is necessary that one of the shaped charges of this first embodiment be angled toward the other so that the two perforations are aligned to intersect one another as far back up into the formation as is practical, thereby providing the two illustrated intersecting tunnels.

Annular or toroidial packer 48 is in the form of a donut and is concentrically arranged with respect to the axial centerline of the shaped charge 44 so that when the charge is detonated, the plasma jet emitted therefrom is directed through the center of the donut, and out into the formation.

Any number of other pairs of chambers can underly chambers 38 and 42, as for example, chambers 50 and 54 which include shaped charges such as seen at 52 therein in the same manner as previously discussed in conjunction with chambers 38 and 42.

FIGS. 2 and 3 set forth the details of several novel aspects of the present invention and in particular, the details of the bulkhead 43. As particularly seen in FIGS. 2, explosive prima cord 56 extends from the gun firing head down into the sub 28, into the chamber 38, through the rear reduced diameter portion of the shaped charge 40, through the vertical passageway 60, into chamber 42, and through the rear reduced diameter portion of shaped charge 44. The prima cord continues into explosive contact with other pairs of chamber containing charges 50 and 54 and through other bulkheads 49 and 53 which are similar to bulkhead 43.

Passageway 62 connects cylinder 64 with the chamber 38 so that the large end of piston 66 is forced to move to the right when sufficient pressure is developed in chamber 38 as a result of the explosion of the prima cord and shaped charge. O-rings 68 are placed concentrically about the piston. The piston reduces in diameter at 70 thereby forming shoulder 72 which can be moved into abutting engagement with wall 73 of the cylinder as noted in FIG. 3. O-ring 74 is placed about the small diameter piston 70 and sealingly engages the reduced diameter cylinder wall 75. As seen in FIG. 3, the end 76 of the reduced diameter piston can be moved into abutment with end 77 of the reduced diameter cylinder.

Port 78 is closed by utilizing commercially available plugs which usually are made of thin steel or aluminum and threadedly engage the wall of the gun. Numeral 80 indicates the path of the plasma jet resulting from detonation of the shaped charge. Numeral 82 indicates a plug identical to the plug at 78, while the arrow indicated by numeral 84 indicates the path of travel of the jet particles when the shaped charge 44 is detonated by the prima cord.

It will occur to those skilled in the art that the relationship of the two shaped charges 40, 44 can be reversed and furthermore, that chambers 38 and 42 could be reversed even though there would be less pressure effected in such an instance for actuation of piston 66.

As seen in FIG. 3, the shaped charges 40, 44 have been detonated by the prima cord and the piston 66 moved to the extreme right, thereby closing port 60 located in bulkhead 43. The plugs 78 and 82 have been volatilized by the jet stream issuing from the shaped charges, thereby perforating the casing and the cement 86 as noted by the perforations at 87 and 88. Numeral 90 indicates a cavity formed back up in the hydrocarbon containing formation which will subsequently be formed in accordance with the method of the present invention. Numerals 92 and 94 are tunnels formed by the shaped charge jet. The tunnels terminate in proximity of focal point 46.

Figure 4:
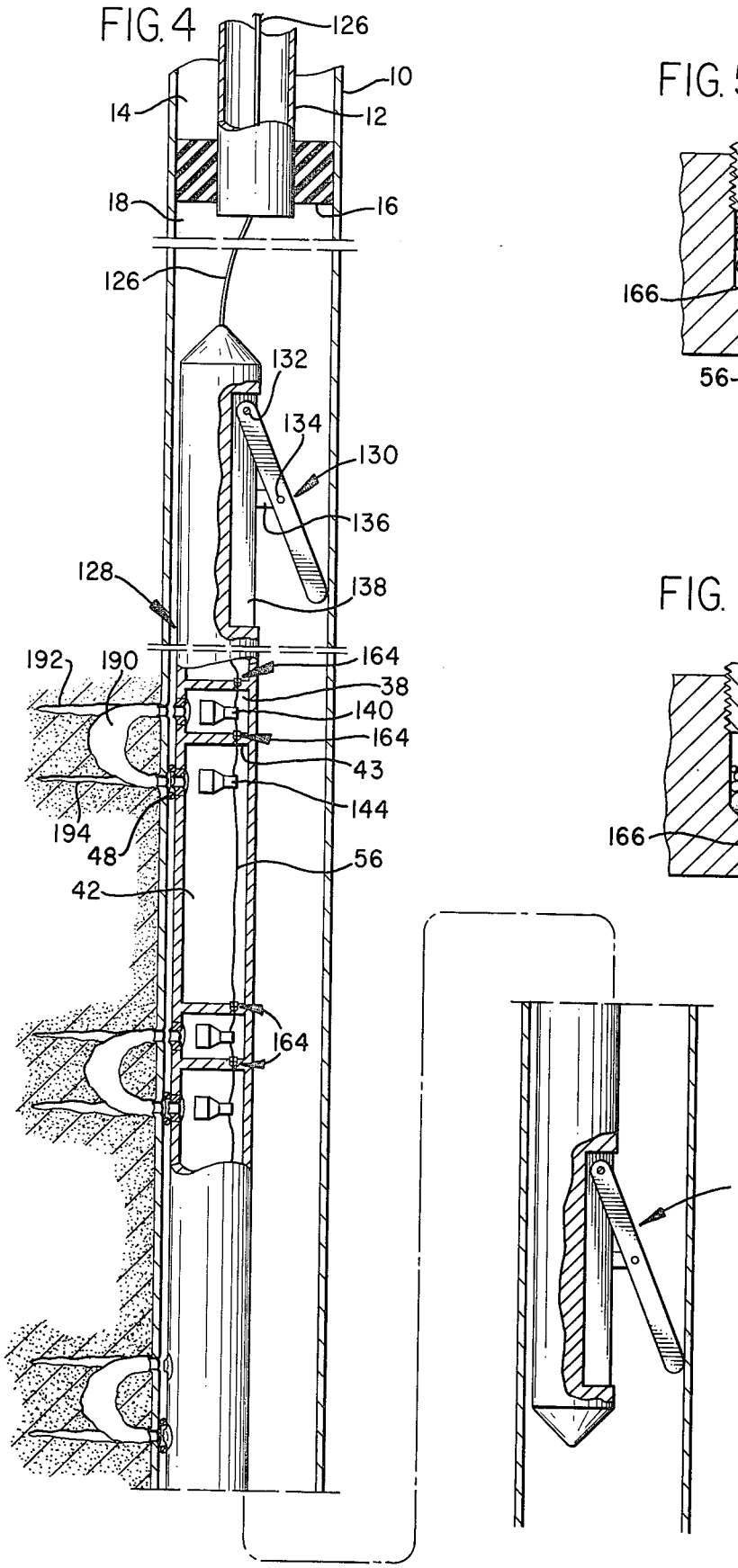
FIG. 4 is a part diagrammatical, part schematical, part cross-sectional representation of a wellbore having apparatus disposed therein made in accordance with another embodiment of this invention.
Figure 5:
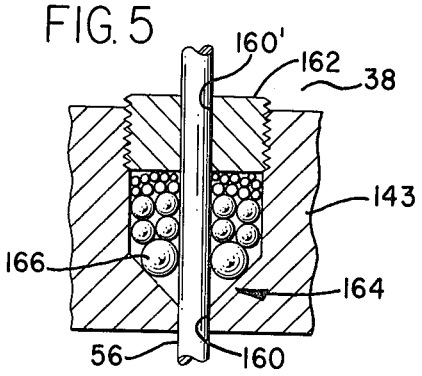
FIG. 5 is an enlarged, broken, isolated cross-sectional view of part of the apparatus disclosed in FIG. 4; and, FIG. 6 is a view of FIG. 5 with the apparatus being disclosed in an alternate configuration.
Figure 6:
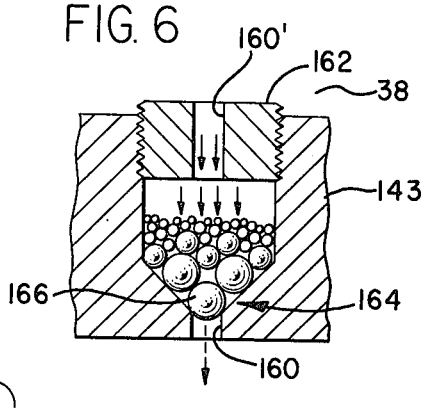

In the embodiment of the invention set forth in FIGS. 4–6 of the drawings, the upper gun sub 128 contains prior art electrical detonation means which initiates the explosion of prima cord 56. Wire line 126 supports the gun and enables it to be lowered downhole through the tubing string and also enables current to be supplied to gun sub 128. Usually an electrically actuated blasting cap is employed to initiate the detonation of the prima cord.

Arm 130 is pivotally connected at 132 to the gun sub, and at 134 to extension lever 136 which extends the arm upon energization of the gun sub by means of the electrical conductor contained within the wire line. Numeral 138 is a recess within which the arm is retractably accommodated.

Shaped charges 140 and 144 are aligned parallel to one another and connected to the prima cord which extends through the chamber forming bulkheads 143, for example. Each of the bulkheads contain an explosive responsive valve device 164, the details of which are set forth in FIGS. 5 and 6.

The valve device 164 includes spaced passageways 160', 160 which lead into and out of a chamber containing balls 166 of various different diameters. The ball containing chamber is funnel shaped with the small balls being located in the upper cylindrical portion of the chamber while the large balls are located in the lower converging part of the chamber.

In FIG. 4, the spaced charges form spaced tunnels 192 and 194 which extend parallel to one another horizontally away from the gun, so that communication can be established therebetween at 190 as a result of the pressure differential produced by chamber 42.

In operation, and in order to practice the method of the first embodiment of the present invention, the gun is run downhole in the configuration illustrated in FIG. 2. It is sometimes advantageous to enter the hole with the vent assembly in the open position. In the present example, however, the vent assembly is in the closed position so that the tubing remains dry. The packer is set, the vent assembly is opened (if not previously opened), while the gun is urged into the illustrated configuration seen in FIG. 1 because of the cooperative action of the linkage, the bow springs, and the cams. This action places each of the donuts 48 in sealed relationship about the plug or window of the shaped charge 44, for example. That is, the donuts is compressed between the inside wall of the casing and the outside wall of the gun.

While running downhole the cams 34 and 36 draggingly engage the inside peripheral wall surface and are moved into an extended position thereby standing off the donuts from the wall. This action prevents damage to the small donut packers 48. Light upward movement of the gun causes the cams to retract towards the center of the gun thus allowing the resilient packer members 48 to sealingly engage the casing wall.

The tubing is filled with the appropriate volumes and stages of pre-flush fluid, plasticizing fluid, and after-flush fluid. The following are examples of consolidating fluids:

Pre-flush fluids: diesel oil, diesel oil with solvents, diesel oil with isopropyl alcohol, diesel oil with surfactants, and propanol.

Plasticizing fluids: epoxy, phenolic-furfuryl, phenyl resin, and phenol formaldehyde.

After flush fluids: kerosene, diesel oil, and diesel oil with surfactants.

An oil-base mud is placed at the uppermost position within the tubing and a source of nitrogen gas pressure or pump pressure is then connected to the tubing on top of the oil-base mud. Of course, if the tubing does not have sufficient volume to accommodate the total volume of the above treatment fluids, then the fluids must be individually pumped into the well in stages by conventional means.

The "go-devil" or bar 96 is dropped down the tubing string from the surface of the earth and free falls with sufficient velocity through the tubing fluids so that when the bar contacts the firing head 22, the prima cord 56 is detonated, thereby detonating each of the shaped charges within each of the small and large chambers of the gun.

As the shaped charge 40 explodes, the pressure within chamber 38 instantaneously increases to a sufficient value whereby the piston 66 of FIG. 2 is forced to the right, causing the small diameter piston to sealingly fill the small diameter cylinder. This unusual advent isolates chamber 42 from chamber 38.

The high velocity jet at 80 perforates the plug, casing, and concrete, while it forms tunnel 92 at the jet penetrates deep into the formation. Almost instantaneously, or microseconds later, shaped charge 44 is detonated by the exploding prima cord and the jet is directed at 84, deep into the formation, thereby forming a tunnel 94 as in the before described manner.

The tunnels 92 and 94 are formed within unconsolidated sand. The walls of the tunnels are compacted and contaminated by debris from the shaped charges and often the disintegrated metal from the charge carrier plug and casing effectively blocks flow from the casing into the perforations, through the tunnels, and into the formation. Thus, treatment of the formation with sand consolidating fluids is prohibited. Where not controlled, the unconsolidated sands may flow along with the production fluid, into the tunnel, back into the perforations, and into the casing thereby causing untold amounts of production trouble.

Accordingly, advantage of the invention is taken by employment of the arrangement illustrated in FIGS. 1 and 4 wherein pre-flush fluid flows from the lower casing annulus into the perforation 88, whereupon a cavity at 90 or 190 is formed as the pre-flush fluids forcibly flow towards the reduced pressure chamber 42 by flowing through the perforation 87, into the ruptured plug 82, and into the large or lower chamber 42. The unconsolidated sands cannot flow into the borehole because the pressure of the treating fluid is higher than the formation pressure. The next step of the method entails consolidating the sands in the vicinity of the cavity 90.

The consolidation is achieved by forcing the plasticizing material back up into cavity 90 and further back up into the formation. and thereafter propping the cavity open by forcing the oil base mud into a cavity. This action builds up a filter-cake on the inside surfaces of the cavity. The pressure on the oil-base mud is maintained at a higher value than the formation pressure thereby holding the cavities propped open so that the sand cannot collapse while the plastic is hardening.

After sufficient time has lapsed for the plastic to harden, the well is put on production, and the mud flushed out of the cavity. At this time, the plastic consolidated sand is strong enough so that the sand will not collapse into the cavity. The gun can remain in the illustrated position set forth in the figures of the drawings, or alternatively, can be dropped into the rathole or subsequently pulled out of the well. The tubing and the packer can be rerun after the well has been cleaned up.

Small chamber 38 is of minimum displacement consistent with proper enclosure of the shaped charge 40 while the large chamber 42 is of the maximum size consistent with the spacing of the cavities 90 from one another within the pay zone, with the relatively larger chamber being at least several times as large as the relatively small chamber. This expedient minimizes the volume of annular fluid ingested into the small chamber and maximizes the quantity of substance withdrawn from the cavity.

In operation of the second embodiment of the invention set forth in FIGS. 4–6, the gun is run down through the tubing string and into the lower borehole 18 by the wire line 126. Current is applied to the wire line whereupon the lever 136 extends arm 130, thereby forcing the gun laterally against the borehole wall, and thereafter detonating the prima cord.

The chambers 38 and 42 are isolated from one another at 164 by the valve means of FIGS. 5 and 6, while the cavity 190 is formed in the before described manner set forth in conjunction with FIG. 1.

After the well has been completed, the arms are retracted into their recesses and the wire line used to retrieve the tool through the tubing string.

The balls at 166 are very hard and range in size from ¼ inch diameter to one-sixthteen inch diameter for a 0.20 inch diameter hole at 160.

I claim:

1. Method of consolidating a formation while completing a well comprising the steps of:

running a jet perforating gun downhole into a cased borehole and positioning the gun against the inside peripheral surface of the casing at a location adjacent to a hydrocarbon bearing formation;

orienting spaced shaped charges which are located in separate charge carrying chambers of a jet perforating gun such that the charges are placed adjacent to the inside peripheral wall of the casing;

filling the borehole with flushing fluid at a location where the casing is to be perforated;

forming spaced tunnels which extend in the same radial direction from the borehole, through the casing, and out into the formation by detonating said shaped charges;

forming a cavity between said tunnels by forcing said flushing fluid to flow from one through the other of said tunnels;

carrying out the last step by forming an isolated flow passageway from one of the tunnels into one of the charge chambers so that flow must occur from the wellbore, into one of said tunnels, out of the other tunnel, and into the last said charge chamber;

pumping a plasticizing fluid into said cavity, said plasticizing fluid having properties which causes it to subsequently consolidate the formation;

pumping an oil base mud into said cavity until a filter cake is built up on the wall of the cavity, thereby propping open the unconsolidated sand until the plasticizing fluid has set up;

continuing to hold the pressure of the oil base mud at a value greater than the formation pressure until the formation has been consolidated, and thereafter placing the well on production.

2. The method of claim 1, and further including the step of separating the two charge containing chambers from one another by a bulkhead, detonating the charge carriers by using a length of prima cord by extending the prima cord from a shaped charge located in one chamber, through a valve located in the bulkhead, and to the shaped charge located in an adjacent chamber;

using the force resulting from the explosion of the shaped charge for closing the valve in the bulkhead, thereby isolating the two charge containing chambers from one another.

3. Method of consolidating and completing a hydrocarbon containing formation located downhole in a borehole comprising the steps of:

mounting shaped charges in separate chambers in a perforating gun and orienting the charges to form spaced tunnels which extend in the same direction radially away from the gun;

running the perforating gun downhole into proximity of the hydrocarbon containing formation; filling the lower borehole with a flushing fluid;

forming a cavity out in the formation which communicates with the borehole by urging the gun towards the inside wall of the borehole and isolating the area between the borehole wall and one of the chambers, firing the gun and forming an isolated flow path to cause fluid to flow from the wellbore, into one of the perforations, out of the other perforation, and into the other chamber, thereby cleaning out the unconsolidated material between the two perforations;

flushing the debris from the cavity and thereafter forcing a plasticizing fluid into the formation, followed by pumping an oil-based mud into the cavity to prop the walls thereof open until the plasticizing fluid hardens;

producing the well to remove the oil-based mud and to thereby place the well on production.

4. The method of claim 3, and further including the step of supporting the gun from a tubing string in proximity of the production zone, moving the gun laterally against the inside wall of the well by using a linkage between the tubing string and the gun;

and pumping the plasticizing and oil based fluids down the tubing string and through a vent located in the lower end of the tubing string.

5. The method of claim 3, and further including the step of running the gun through the tubing string by a wireline, using the wireline to cause the gun to be moved laterally into contact with the casing wall, and retrieving the gun after the well has been completed.

6. The method of claim 1 and further including the step of forming a plurality of cavities simultaneously; pumping an unlimited volume of treatment fluid from the surface simultaneously into all of the cavities.

7. The method of claim 3 and further including the steps of:

spacing a plurality of pairs of shaped charges along the gun, firing all of said plurality of charges substantially simultaneously, thereby forming a plurality of cavities spaced from one another; and, forcing the plasticizing fluid from the earth's surface into the plurality of cavities simultaneously.

8. Jet perforating gun apparatus comprising an elongated main housing having a firing head, a plurality of charge containing chambers spaced from each other by a bulkhead, a shaped charge located in each said chamber, and means connected to each shaped charge and to said firing head for detonating the shaped charges;

adjacent shaped charges being oriented in the same radial direction for perforating a formation with the perforations extending back up into the formation and oriented to extend in close proximity of one another;

annular seal means positioned on the exterior of the gun in axial alignment with one of the shaped charges such that the plasma jet from a detonated charge extends through the central axis of the annular seal means;

means forcing the main housing laterally against the borehole wall to cause said annular seal means to isolate well fluids from the immediate path of the plasma jet so that when the shaped charges are fired, the chamber adjacent said annular seal means is directly connected to the perforation formed through the borehole wall thereof;

valve means in said bulkhead, said means connected to said shaped charges and to said gun firing head, extends through said valve means; said valve means includes means by which it is moved to the closed position in response to detonation of a shaped charge in one of said chambers;

so that when the charges are detonated, the pressure gradient will force well fluids to flow from the wellbore, into one perforation, out of the other perforation; through the annular seal means and into the chamber adjacent thereto thereby forcing a cavity across the two perforations.

9. The jet perforating gun apparatus of claim 8 wherein said valve means is located in said bulkhead, and includes a cylinder having a large and a small bore co-extensive with one another and arranged along a common axial centerline, a piston having a large and a small diameter portion, said piston being reciprocatingly received within said cylinder with the large diameter and small diameter part of the piston, respectively, being received in close tolerance relation within said large and small diameter bore of said cylinder, respectively;

a passageway formed through said bulkhead through which a marginal length of said means connected to said shaped charges extend, said passageway extends laterally through said small bore; and a flow path which extends from one said chamber to the end of the large diameter cylinder which is opposed to the small diameter cylinder;

so that, detonation of the shaped charge in said one said chamber moves the piston towards the small diameter cylinder to close the passageway with the small piston.

10. The gun apparatus of claim 8 wherein said means connected to said shaped charges is a length of prima cord, and said gun firing head initiates explosion of the prima cord which in turn detonates the shaped charges whereupon the valve means is moved to the closed position while an isolated flow path is formed from a chamber, through the annular seal, and back up into the formation.

11. The jet perforation apparatus of claim 8 wherein the valve means is located in the bulkhead and includes a bore having a conical lower end which reduces into a passageway, the last said passageway leads into a lower of said chambers with there being a second passageway leading into an upper of said chambers, a ball located in the last said bore, said ball is of a diameter greater than said passageway;

said means connected to said shaped charges being received through said bore and into said upper and lower chambers so that when said shaped charges are detonated, the ball seats against the conical lower end to preclude flow into the isolated chamber.

12. The apparatus of claim 11 wherein said means connected to said shaped charges is a length of prima cord;

said bore contains a plurality of balls of various different diameters so that flow up through the conical lower end is minimized while flow down through the conical seat is precluded after the prima cord has been detonated.

13. The apparatus of claim 8 wherein said biasing means is an arm pivotally affixed to said housing, means for extending said arm so that the gun is moved laterally against the borehole wall.

* * * * *